US005142265A

United States Patent [19]

Motoyoshi et al.

[11] Patent Number: 5,142,265

[45] Date of Patent: Aug. 25, 1992

[54] POSITIVE TEMPERATURE COEFFICIENT THERMISTOR DEVICE

[75] Inventors: Yoshimitsu Motoyoshi, Bibai; Masato Nagano, Iwamizawa, both of Japan

[73] Assignee: Nippon Oil & Fats Co., Ltd., Tokyo, Japan

[21] Appl. No.: 668,176

[22] Filed: Mar. 12, 1991

[30] Foreign Application Priority Data

Apr. 5, 1990 [JP] Japan ..... 2-36170

[51] Int. Cl.[5] ..... H01C 7/10; H01C 1/026

[52] U.S. Cl. ..... 338/22 R; 338/235; 338/260; 338/276

[58] Field of Search ..... 338/22 R, 22 SD, 260, 338/276, 235

[56] References Cited

U.S. PATENT DOCUMENTS 4,973,934 11/1990 Saito et al. ..... 338/22 R

FOREIGN PATENT DOCUMENTS 6025205 2/1985 Japan .

60-259076 12/1985 Japan .

*Primary Examiner*—Marvin M. Lateef

*Attorney, Agent, or Firm*—Oblon, Spivak, McClelland, Maier & Neustadt

[57] ABSTRACT

A positive temperature coefficient thermistor device includes an insulating casing housing a pair of positive temperature coefficient thermistors. Each of the inner surfaces of a pair of opposed walls consisting of the side walls and the top and bottom walls of the case is provided with a recess formed of at least one pair of tapered surfaces sloping from the walls provided with a pair of electrodes towards a common electrode located in the center. The thermistors are arranged so that the rim thereof has at least a one-point contact with the tapered surfaces of the recesses.

15 Claims, 3 Drawing Sheets

POSITIVE TEMPERATURE COEFFICIENT THERMISTOR DEVICE

BACKGROUND OF THE INVENTION

1. Field of the Invention

The present invention relates to a dual type positive temperature coefficient thermistor device, i.e. a positive temperature coefficient thermistor device having a pair of positive temperature coefficient thermistors housed in an insulated case. The invention particularly relates to an improved arrangement for supporting each of the thermistors in the insulated case.

2. Prior Art Statement

The above-described dual-type positive temperature coefficient thermistor device can be applied to the degaussing circuit of a color television, for example, if one of the thermistors is used as a heat emitter and the other thermistor is used as a heat receiver. Typical commercial devices of this type are disclosed in Japanese Patent Public Disclosures No. 60-25205 and No. 60-259076, for example, and have a sectional construction as illustrated in FIG. 5.

This will now be explained as an example of a conventional device according to the prior art. Where appropriate, reference may be made to FIG. 2, which is an exploded perspective view of an embodiment of the device according to the present invention, as this embodiment has the same structure as the prior art example, except for those parts that constitute an improvement in accordance with the present invention as described hereinafter.

With reference to the positive temperature coefficient thermistor device shown in FIG. 5, the interior of an insulating case 4, made of resin or the like, is closed by a top 6. Housed within the case is a pair of positive temperature coefficient thermistors 1. Normally the shape of the insulating case 4 is that of a square box, and each of the thermistors 1 is in the form of a disk of a requisite thickness with a terminal/electrode on the faces of the disk.

In the insulating case 4, a common electrode 2 is arranged between the two thermistors 1 to form a configuration whereby the opposed disk faces and terminal-/electrode surfaces of the thermistors 1 are each provided with a common electrical connection. The inner surfaces of one pair of opposed side walls 5 of the insulating case 4 are each provided with an electrode 3 having a resilient contact means 7 in pressure contact with the corresponding terminal/electrode surface of the thermistors 1.

In the arrangement shown in FIG. 5, the resilient contact means 7 are electrically conductive springy strips. The resilient contact means 7 are arranged thus to ensure that there is an electrical connection between the electrodes 3 and the terminal/electrode surfaces of the thermistors 1, and to stably maintain the thermistors 1 in their requisite face-to-face position. As such, in some cases the number of these resilient contact means 7 in increased to enhance their function by increasing the number of contact points. An example of this is shown in FIG. 2, in which the resilient contact means 7 are each formed as a pair of parallel strips.

The bottom wall 8 of the insulating case 4 is provided with slits 9 and 10 (FIG. 2) through which the tips 2' and 3' of the common electrode 2 and electrodes 3 project from the case. The dimensions of the tips 2' and 3' of the electrodes projecting from the case are reduced to enable them to be directly connected to a printed circuit board (not shown). Resilient tongues 11 and 12 are punch-formed in the narrow sections of the electrodes 2 and 3 in such a way that they allow the electrodes to be pushed into the slits but by then springing up once they clear the slits prevent the electrodes from being inadvertently pulled back into the case.

A conventional dual-type positive temperature coefficient thermistor device has the above-described structure. The object of the present invention resides in the means used to maintain the mutual alignment of the thermistors 1 in the insulating case 4. In the prior art, as described above, the resilient force of a pair of resilient contact means 7 pressing the thermistors 1 towards each other is used for the purpose. However, a single pair of resilient contact means 7 is not always enough to maintain the position of the thermistors 1 under the various conditions encountered from fabrication and assembly of the device through to actual use.

Even with the force of the resilient contact means 7 urging the thermistors 1 against the common electrode 2, as such force is only exerted on an area at the center of the face of the thermistors 1, strong vibration, shocks and the like can jolt the thermistors 1 out of the vertical, as illustrated in FIG. 6, or can cause them to shift sideways out of mutual alignment, along the common electrode 2 (that is, in a direction normal to the FIG. 6 sheet).

Especially in the case of an application such as that of a degaussing circuit described above in which one of the positive temperature coefficient thermistors 1 is used as a heat emitter and the other thermistor 1 as a heat receiver, that is, a thermocouple application, in addition to causing a major deviation from design and target values of the thermistor device itself, such misalignment of the thermistors also gives rise to major deviation from the expected electrical characteristics of the overall circuit system in which the device is used.

Thermistors can slip out of the vertical while being inserted into the case during the assembly of the device (FIG. 6). Care is needed to avoid this happening, which slows down the assembly process. In practice, thermistors are more likely to shift out of the vertical than to move sideways, and vertical misalignment gives rise to greater variation in the thermal and electrical characteristics.

OBJECT AND SUMMARY OF THE INVENTION

The object of the present invention is to overcome the above-described drawbacks by providing a dual-type positive temperature coefficient thermistor device arrangement which ensures highly stable maintenance of the correct mutual position of the two component thermistors in the case.

In order to achieve the aforesaid object, the positive temperature coefficient thermistor device according to the present invention comprises an insulating case having a hollow interior space defined by side walls and a top and a bottom wall, two flat positive temperature coefficient thermistors each having a front and a reverse face which are arranged in the interior space of the insulating case in a position of mutually opposed alignment on either side of a common electrode and between a pair of resilient contact means which urge the thermistors towards each other, and a portion of the common electrode and a portion of each of a pair of electrodes on which are formed the resilient contact means are arranged so that they project from the insulating case for effecting an electrical connection with an external circuit, the improvement to the positive temperature coefficient thermistor device thus arranged comprising the following structural elements (i) to (iii):

(i) The provision of a recess on the inner surfaces of the top and bottom walls of the insulating case;

(ii) Providing the recesses with at least one pair of tapered surfaces each of which slopes from the vicinity of the electrodes provided on the inner surfaces of the side walls of the case, towards the position of the centrally located common electrode;

(iii) Contact between at least one point on the rim of each of the round thermistors on the resilient contact means side (electrode side) and one of the pair of recess tapered surfaces.

The above is the basic arrangement of the positive temperature coefficient thermistor device according to the present invention, and includes a configuration in which the interior space of the case is in the form of a square defined by four side walls each of which is at right-angles to the next, and instead of forming the recesses in the top and bottom wall, the recesses are formed on the inner surfaces of the pair of side walls at right-angles to the side walls provided with the electrodes.

The present invention also includes, as an additional structural element, any one preferred combined configuration of two recesses comprised of one of each of the recesses formed in the top and bottom wall or in a pair of opposed side walls. That is, a pair of tapered surfaces is used to form one V-shaped recess, and the other recess is in the shape of a square pyramid with an apex located below the common electrode or thereabouts and a base diagonal oriented in the direction in which the two electrodes are separated, whereby there is a total of four tapered surfaces for each thermistor.

Thus, although this invention can also be applied to square thermistors, as described hereinbelow, when the usual disk-shaped positive temperature coefficient thermistors are used, taking into consideration the diameter of the thermistors, with respect to the appropriate recess design and taper degree, the invention also includes additional structural elements whereby the rim of a face of the thermistors is in contact at one point with a tapered surface of the V-shaped recess and in one-point contact with each of two of the four tapered surfaces of the square pyramidal recess.

In accordance with the present invention, of the component wall which constitute the insulating case, the inner surface of two surfaces which are mutually opposed in a direction that is at right-angles to the thickness dimension of the two thermistors (that is, the direction in which the thermistors are in mutual alignment), meaning the inner surfaces of the top and bottom wall or of the two side walls not equipped with resilient contact means, are each provided with at least one pair of tapered surfaces forming a recessed portion. Moreover, the rim of the thermistor surface on the resilient contact side and the corresponding tapered surface contact at one or more points, and this contact provides physical resistance (controlling force) that prevents the thermistors tilting. In other words, any tendency for one thermistor to move in a direction of separation from the other thermistor is arrested by the contact of two or more opposing points on the thermistor rim with at least one of the opposing tapered surfaces.

As defined in this invention by the expression "at least two," with the recess being V-shaped, this effect can also be obtained in cases where each comprises just two tapered surfaces, the minimum number necessary, so that in addition to applying a controlling force to the thermistors, sideways deviation of thermistors along the common electrode is prevented by the frictional force of the contact between thermistor surface and tapered surface.

In a further arrangement according to the present invention in which one recess is V-shaped and so only has two tapered surfaces, and the other recess is a square pyramidal shape with four tapered surfaces, both tilting and horizontal movement of thermistors are effectively prevented.

While this explanation relates to the usual disk-shaped thermistors having flat, round surfaces, it also applies to square thermistors. In the case of square thermistors, one side of a thermistor abuts one of the tapered surfaces forming the V-shaped recess, and the ends of the opposite side abut two of the four tapered surfaces of the square pyramidal recess, forming a stable three-point contact arrangement in which a one-point contact becomes a line contact, preventing tilting or horizontal movement of the thermistors.

In the case of round thermistors, the side abutting against one tapered surface can be viewed as a point, producing a three-point support structure that efficiently prevents tilting and horizontal movement.

Both recesses can be formed as square pyramids, thereby providing four-point support for each thermistor.

The effect of the invention is achieved not only when the recesses are provided in the top and bottom wall of the insulating case, but also when recesses are formed on the inner surfaces of the pair of side walls at rightangles to the pair of side walls provided with resilient contact means.

Further features of the invention, its nature and various advantages will be more apparent from the accompanying drawings and following detailed description of the invention.

DETAILED DESCRIPTION OF THE PREFERRED EMBODIMENTS

Figure 1:
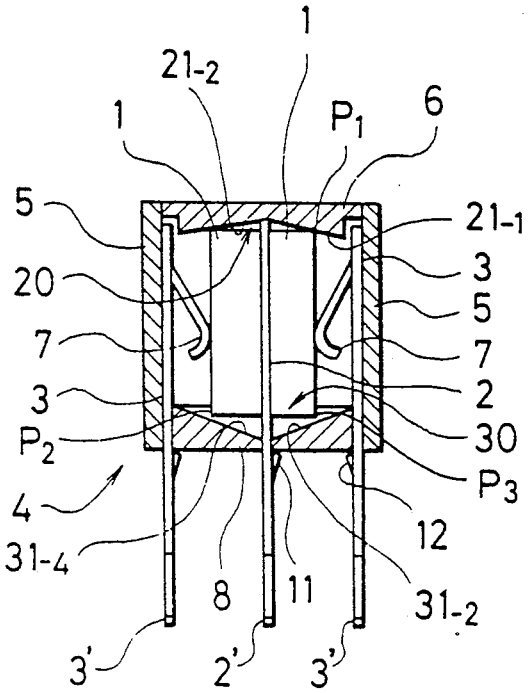
FIG. 1 is a cross-sectional view of the principal parts of an embodiment of the positive temperature coefficient thermistor device according to the present invention.
Figure 2:
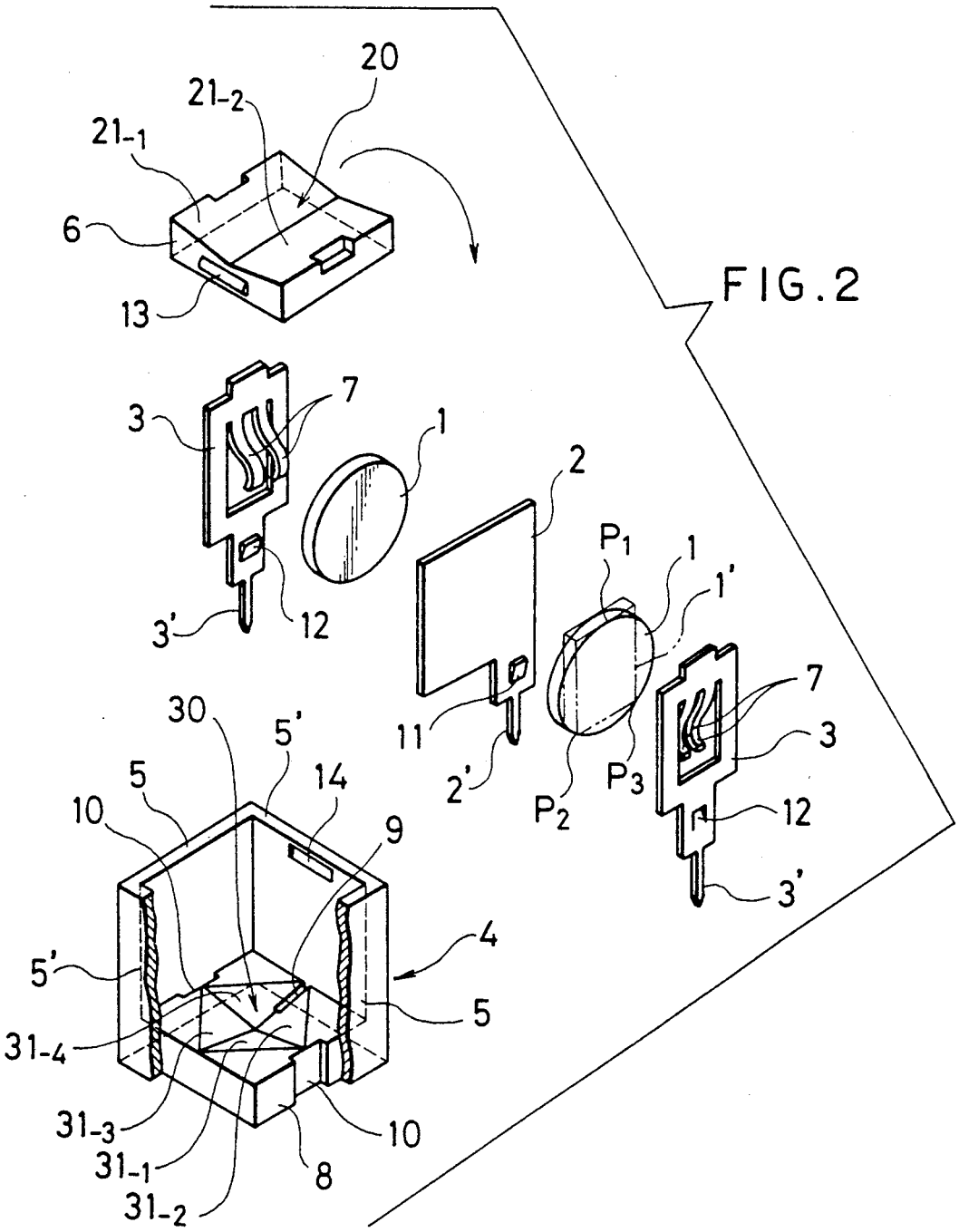
FIG. 2 is an exploded perspective view of the thermistor device of FIG. 1.
Figure 5:
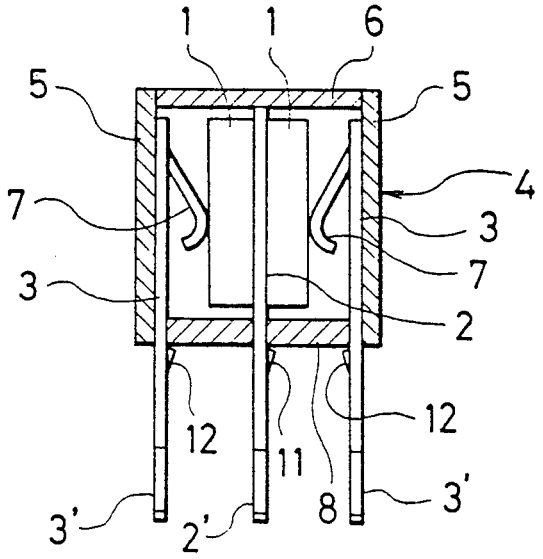
FIG. 5 PRIOR ART
FIG. 5 shows the arrangement of a representative prior art example of a positive temperature coefficient thermistor device.

FIGS. 1 and 2 are views of one embodiment of the positive temperature coefficient thermistor device according to the present invention. For convenience when comparing the present invention with the prior art example shown in FIG. 5, with the exception of parts that are improvements according to this invention, like parts have been given the same reference numerals.

In this embodiment, an insulating case 4 of resin or the like that has a hollow interior is formed as a box defined by four sides 5 and 5', each at right-angles to the adjacent walls, a bottom wall 8 that closes the lower end of the hollow interior, and a top 6 covering the upper end.

In this embodiment the side walls 5 and 5' and the bottom wall 8 are made of resin and formed in one piece, and only the top 6 is a separate piece. After the positive temperature coefficient thermistors 1 and the electrodes 2 and 3 are placed in the case, the case is closed by shutting the top 6, which brings engagement ridges 13 provided on opposite edges of the top 6 into engagement with corresponding engagement grooves 14 provided on the upper part of the corresponding side wall 5'. (In FIG. 2, only one of the engagement ridges 13 and one of the engagement grooves 14 are visible.) The case assembly method is not directly defined by this invention and may be any suitable method.

The pair of thermistors 1 are arranged in a position of opposed alignment in the insulating case 4, one on each side of the common electrode 2. Although not illustrated in the drawings, the faces of the thermistors 1 act as a terminal/electrode, or a terminal/electrode is formed on the faces, so the common electrode 2 has a common electrical connection with the mutually opposed terminal/electrode faces of the thermistors 1. Each of the thermistor terminal/electrode faces on the side facing away from the common electrode 2 are contacted by the resilient contact means 7 provided on each of the electrodes 3 on the two opposing side walls 5 of the insulating case 4.

The illustrated resilient contact means 7 are constituted as a pair of parallel springy strips stamped out of the electrodes 3. As described with reference to the prior art, the function of the resilient contact means 7 is to ensure positive electrical contact with the terminals of the thermistors 1, and to stabilize, to a certain degree, the position of the thermistors 1. The shape or form of the resilient contact means is not limited to that shown in the examples, and may be any other shape or form that ensures the requisite function is provided. Although not directly pertinent to the invention, when the contact area of the contact means is small, as in the illustrated examples, it serves to reduce or suppress undesirable transmission of heat to external circuitry to which the electrodes are electrically and physically connected via the ends of the electrodes that project from the case.

The bottom wall 8 of the case has a slit 9 through which the slender tip 2' of the common electrode 2 projects. This is to enable the electrode 2 to be readily connected to an external circuit board terminal, by soldering or other such means. The case 4 is also provided with slits 10 through which the tips 3' of the electrodes 3 project to enable them to be easily connected with external circuits.

The electrodes 2 and 3 are provided with resilient tongues 11 and 12, which are press-formed from the electrodes. During the assembly of the device, these resilient tongues 11 and 12 are pushed down by the passage of the electrodes 2 and 3 through the slits 9 and 10. When clear of the slits, the tongues 11 and 12 spring back up, against the outer surface of the bottom wall, ensuring the parts are maintained in the proper position. Although the electrodes are described here as projecting through slits in the bottom of the case, this is not limitative. The electrodes could instead be made to project from one of the side walls 5 or 5'.

Up to this point, in terms of structure the constituent parts of this embodiment are essentially the same as those of a conventional positive temperature coefficient thermistor device. The structural elements of the embodiment that constitute the improvements according to the invention reside in the arrangements of the inner surfaces of the top 6 and bottom wall 8.

With reference to FIG. 2 in which the top 6 is shown upside down, a V-shaped recess 20 constituted of tapered surface 21-1 and 21-2 is formed on the inner surface of the top 6. As is clearly shown in FIG. 1, the tapered surfaces 21-1 and 21-2 slope upward from the electrodes 3 to the common electrode 2, therefore the deepest point of the V-shaped recess 20 is at the junction of the legs of the V, that is, at or near the position of the common electrode 2.

A recess 30 is also provided in the inner surface of the bottom wall 8. In shape, this recess appears to have been formed by pressing an inverted square pyramidal into the surface, giving the recess four tapered surfaces 31-1, 31-2, 31-3 and 31-4. One of the diagonals of the base of the recess pyramid extends from one electrode 3 to the other (hence the other diagonal is parallel to the electrodes 3) and the apex of the pyramid is below the common electrode 2 or thereabouts.

Each of the tapered surfaces 31-1, 31-2, 31-3 and 31-4 forms a triangle, one side of which extends diagonally across surface of the bottom wall 8 from the center point of one side of the bottom wall 8 to the center point of an adjacent side. The other two sides slope down to a central point which is vertically below the intersection of the two diagonals of the bottom wall 8.

FIG. 1 shows a cross-section of the device formed by arranging the pair of thermistors 1 in the insulating case 4, one on each side of the common electrode 2, sandwiching the thermistors 1 between the resilient contact means 7 of the electrodes 3, and closing the top 6 in which the V-shaped recess 20 is formed.

What is important here is the contact relationship between the edge of each thermistor on the side facing away from the common electrode 2, and the tapered surfaces of the recesses 20 and 30. This relationship is effected by designing the various dimensional factors such as the thickness of the top 6 and bottom wall 8, the depths of the V-shaped recess 20 and recess 30, tapered surface dimensions and taper gradient, in accordance with the diameter and thickness of the thermistors 1.

This contact relationship will now be examined in more detail. With the thermistors 1 used in this embodiment being circular, of the three points P1, P2 and P3 indicated on the rim of the face of the thermistor 1 shown on the right in FIG. 2, i.e. the side of the thermistor 1 facing away from the common electrode 2, the highest point, P1, contacts tapered surface 21-1 of the V-shaped recess 20 formed in the top 6, as shown in FIG. 1.

The remaining two points P2 and P3 contact the respective tapered surfaces 31-1 and 31-2 of the bottom wall 8 recess 30. As FIG. 1 is a cross-sectional depiction, only one of the contacts by P2 and P3 is shown, that of P3 and tapered surface 31-2.

This contact relationship also applies in the case of the other thermistor 1, the one shown on the left. That is, of the corresponding three points (for simplicity, the three points on this other thermistor are not labelled) on the corresponding surface rim, the top point contacts the other tapered surface 21-2 on the top 6 while the other two points contact the remaining two tapered surfaces 31-3 and 31-4 of the bottom wall 8.

Figure 6:
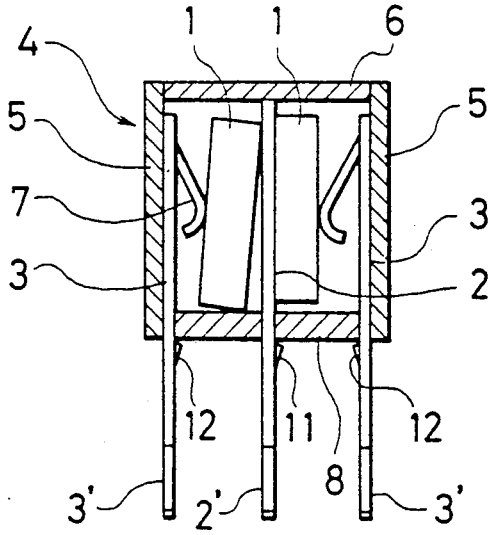
FIG. 6 PRIOR ART
FIG. 6 is an explanatory drawing of an incorrect state that can arise with the thermistor device shown in FIG. 5.

This arrangement thus provides each of the thermistors 1 with a three-point support in which the orientation of the tapered surfaces is such that the thermistors 1 are pushed towards each other and kept from moving away from each other even when subjected to vibration and shocks. The type of tilting that occurs with the conventional arrangement, shown in FIG. 6, is therefore prevented.

This three-point support arrangement also serves to position the thermistors 1 in the insulating case 4, easing the task of inserting the thermistors 1 in the insulating case 4.

In addition, the use of the three-point support arrangement means that contact between the thermistors 1 and other parts of the insulating case can be avoided. Thus, for example, in applications where the thermistors are expected to heat up, such as in the automatic degaussing circuit mentioned above, transmission of this heat to the insulating case can be avoided and the heat can be evenly dissipated. This is in contrast to the prior art, in which shocks or vibration can cause the thermistors to contact the inner surface of the case at different points, causing fluctuation of the heat dissipation relationship and giving rise to variation in thermistor characteristics and from thermistor to thermistor.

A change to rectangular thermistors in place of the round ones described herein can be readily accommodated by making dimensional alterations to the design of the recesses and tapered surfaces. This can be readily understood from a consideration of the rectangular thermistor 1' indicated in FIG. 2 by the phantom lines.

In the case of this thermistor 1', the upper edge on the electrode side passes through the point P1 described above, forming a line contact with the tapered surface 21-1 of the V-shaped recess 20. The ends P2 and P3 of the opposite side of the rectangle are analogues of the points P2 and P3 described with reference to thermistor 1, and therefore contact the same tapered surfaces 31-1 and 31-2 of the recess 30.

As such, even when a rectangular thermistor 1' is used, the tapered surface arrangement of the recesses 20 and 30 form a modified three-point support structure, with one point contact becoming a line contact, thereby holding the thermistors in place and also serving to position the thermistors in the case.

The foregoing has been an explanation of the illustrated embodiment. This arrangement can be modified by swapping the configurations of the recesses 20 and 30, whereby the recess 20 on the top is made pyramidal and the recess 30 at the bottom is made V-shaped. Or, both the top and bottom recesses 20 and 30 can be made pyramidal, giving the increased stability of a four-point support system.

Figure 3:
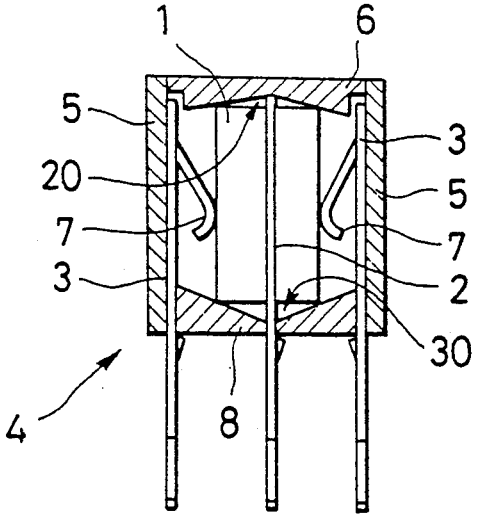
FIG. 3 is a cross-sectional view of the principal parts of another embodiment of the positive temperature coefficient thermistor device according to the present invention.

Compared with the prior art arrangements which lack the tapered surface concept of this invention, even making both of the recesses V-shaped, as shown in FIG. 3, is effective enough. That is, in such an arrangement, using a round thermistor, the thermistor would be supported by contact at two points, between P1 and the tapered surface at the top and by the same kink of contact with the corresponding tapered surface of a V-shaped recess at the bottom, which is still enough to hold the thermistor stably in place.

Such an arrangement would not provide sufficient support to prevent thermistors from shifting horizontally out of alignment, or tilting in a horizontal plane; that is, in a direction perpendicular to the tilting shown in FIG. 6. However, suitable taper surface dimensioning can be used to provide a contact frictional force able to resist, to some extent, thermistor movement in such directions. Also, in the case of a rectangular thermistor 1' shown in the drawing by the phantom lines, both contacts would become line contacts, effectively suppressing movement in either direction.

Figure 4:
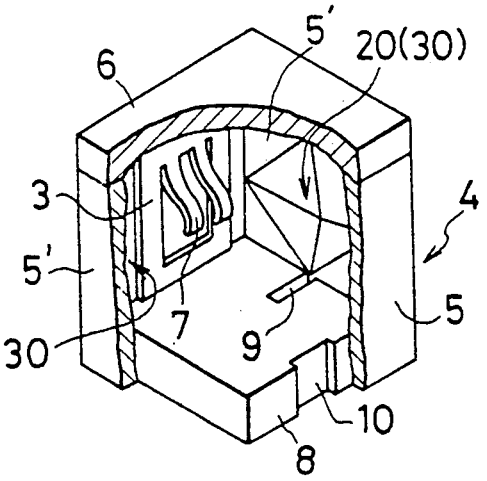
FIG. 4 is a partially cutaway perspective view of the principal parts of still another embodiment of the positive temperature coefficient thermistor device according to the present invention.

Also, the above description only relates to the provision of a pair of recesses 20 and 30 in the top 6 and bottom wall 8. However, the recesses could be provided in the side walls 5', i.e. the side walls not equipped with a electrode 3 as shown in FIG. 4. In this case, since the thermistors 1 are fitted in the recesses 20 and 30, the same effects as in the previous embodiments can be obtained.

When actual assembly of such a device is considered in which the side walls 5' are provided with tapered recesses, if one of the recesses (recess 30, for example) were pyramidal in shape, it could be difficult to insert the thermistors 1 and the electrodes 2 and 3 into the case 4. However, forming the case 4 from a material having sufficient elasticity would make such an operation quite feasible, provided that the case is constructed so that it is finally completed by the attachment of one of the side walls 5'.

Again, while in the illustrated examples the recesses are formed in the top 6 and bottom wall 8 (or in the side walls 5'), the recesses could be fabricated separately and then affixed to the inner surfaces of the top 6 and bottom wall 8 (side walls 5').

Furthermore, instead of a square box shape, the case could be made cylindrical, inside and out, as the electrodes 3 could still be provided opposite to each other and the tapered surface recesses of the invention could still be formed at the top and bottom.

What is claimed is:

1. A positive temperature coefficient thermistor device comprising:

an insulating case have an hollow interior space defined by side walls and opposed top and bottom walls, wherein said top wall and bottom wall have respectively a first recess formed within said insulating case and provided with at least one pair of tapered surfaces terminating in a bottom of said first recess, and a second recess formed within said insulating case and provided with at least one pair of tapered surfaces terminating in a bottom of said second recess;

a common electrode provided in said insulating case so that one end thereof is disposed on said bottom of said first recess;

a pair of positive temperature coefficient thermistors accommodated within said insulating case so as to sandwich said common electrode therebetween and each having a rim kept in contact with said at least one pair of tapered surfaces of each of said first and second recesses at least one point; and a pair of electrodes extending along said side walls, facing said common electrode and each having resilient contact means projecting toward said common electrode to urge the corresponding thermistor toward said common electrode and form electrical connection between said pair of electrodes and said thermistors;

said common electrode and said pair of electrodes each having a portion arranged so as to project from said insulating case for effecting electrical connection with external circuitry.

2. The positive temperature coefficient thermistor device according to claim 1, wherein the interior space of said insulating case in the form of a square column defined by four side walls each of which is at right angles to the next.

3. A positive temperature coefficient thermistor device comprising:

an insulating case having a hollow interior space defined by said walls and opposed top and bottom walls, wherein the interior space of said insulating case is in the form of a square column defined by four side walls each of which is at right angles to the next, and first and second opposed side walls have respectively a first recess formed within said insulating case and provided with at least one pair of tapered surfaces terminating in a bottom of said first recess, and a second recess formed within said insulating case and provided with at least one pair of tapered surfaces terminating in a bottom of said second recess;

a common electrode provided in said insulating case;

a pair of positive temperature coefficient thermistors accommodated within said insulating case so as to sandwich said common electrode therebetween and each having a rim kept in contact with said at least one pair of tapered surfaces of each of said first and second recesses at at least one point;

and a pair of electrodes extending along said side walls, facing said common electrode and each having resilient contact means projecting toward said common electrode to urge the corresponding thermistor toward said common electrode and form electrical connection between said pair of electrodes and said thermistors;

said common electrode and said pair of electrodes each having a portion arranged so as to project from said insulating case for effecting electrical connection with external circuitry.

4. The positive temperature coefficient thermistor device according to claim 1, wherein one of said first and second recesses is formed into a V-shaped recess having a pair of tapered surfaces and the other recess is formed in the shape of a square pyramid, with an apex located below a lower surface of said common electrode or thereabouts and a base diagonal oriented in a direction in which said pair of electrodes are separated, forming a total of four tapered surfaces for each thermistor.

5. The positive temperature coefficient thermistor device according to claim 2, wherein one of said first and second recesses is formed into a V-shaped recess having a pair of tapered surfaces and the other recess is formed in the shape of a square pyramid, with an apex located below a lower surface of said common electrode or thereabouts and a base diagonal oriented in a direction in which said pair of electrodes are separated, forming a total of four tapered surfaces for each thermistor.

6. The positive temperature coefficient thermistor device according to claim 3, wherein one of said first and second recesses is formed into a V-shaped recess having a pair of tapered surfaces and the other recess is formed in the shape of a square pyramid, with an apex located below a lower surface of said common electrode or thereabouts and a base diagonal oriented in a direction in which said pair of electrodes are separated, forming a total of four tapered surfaces for each thermistor.

7. The positive temperature coefficient thermistor device according to claim 4, wherein said thermistors are flat disk-shaped thermistors and each having a rim having a one-point contact with a tapered surface of said V-shaped recess and a one-point contact with each of two of the four tapered surfaces of said square pyramidal recess.

8. The positive temperature coefficient thermistor device according to claim 5, wherein said thermistors are flat disk-shaped thermistors and each having a rim having a one-point contact with a tapered surface of said V-shaped recess and a one-point contact with each of two of the four tapered surfaces of said square pyramidal recess.

9. The positive temperature coefficient thermistor device according to claim 6, wherein said thermistors are flat disk-shaped thermistors and each having a rim having a one-point contact with a tapered surface of said V-shaped recess and a one-point contact with each of two of the four tapered surfaces of said square pyramidal recess.

10. The positive temperature coefficient thermistor device according to claim 2, wherein said top wall has a construction for allowing attachment of said top wall to said four side walls.

11. A positive temperature coefficient thermistor device comprising:

an insulating case having a hollow interior space defined by four side walls, a top wall and a bottom wall, each of opposed surfaces of said top and bottom walls having a recess provided with at least one pair of tapered surfaces terminating in a bottom of said recess, said top wall being fitted in an opening of said insulating case defined by said four side walls;

a common electrode disposed at the center of said hollow interior space of said insulating case and having a part projecting outward from said bottom wall;

a pair of electrodes extending along the side walls facing each other, and each having resilient contact means projecting toward said common electrode and a part projecting outward from said bottom wall; and a pair of positive temperature coefficient thermistors interposed between said common electrode and said pair of electrodes, pushed against said common electrode by said resilient contact means and each having a rim kept in contact with said at least one pair of tapered surfaces of said top wall at at least one point and with said at least one pair of tapered surfaces of said bottom wall at at least one point.

12. The positive temperature coefficient thermistor device according to claim 11, wherein the recesses of said top and bottom walls are formed into a V-shape.

13. The positive temperature coefficient thermistor device according to claim 11, wherein the recesses of said top and bottom walls are formed in the shape of a quadrangular pyramid.

14. The positive temperature coefficient thermistor device according to claim 11, wherein one of the recesses of said top and bottom walls is formed into a V-shaped and the other recess is formed in the shape of a quadrangular pyramid.

15. The positive temperature coefficient thermistor device according to claim 11, wherein said resilient contact means comprises a pair of leaf springs extending from said top wall toward said bottom wall.

* * * * *